United States Patent [19]

Aldo

[11] Patent Number: 4,543,151

[45] Date of Patent: Sep. 24, 1985

[54] DAYLIGHT APPARATUS FOR BREAKING OPEN A FILM CASSETTE, IDENTIFYING THE FILM RELEASED THEREFROM, AND SPLICING SAME TO THE NEXT PRECEDING FILM

[75] Inventor: Bruce D. Aldo, Granville, Mass.

[73] Assignee: CX Corporation, Seattle, Wash.

[21] Appl. No.: 514,582

[22] Filed: Jul. 18, 1983

[51] Int. Cl.[4] ..... G03D 15/04; G03D 17/00

[52] U.S. Cl. ..... 156/502; 81/3.2; 156/506; 226/92; 354/310; 354/313

[58] Field of Search ..... 156/502, 506, 159, 304.3; 354/307, 310, 313, 314; 226/91, 92; 81/3.2; 220/285

[56] References Cited

U.S. PATENT DOCUMENTS

| | | | |
|---|---|---|---|
| 2,612,065 | 9/1952 | Packer et al. | 81/3.2 |
| 3,577,302 | 5/1971 | Szakacs | 156/506 |
| 3,618,429 | 11/1971 | Frueliger | 81/3.2 |
| 3,779,837 | 12/1973 | Zahn et al. | 156/506 |
| 3,925,143 | 12/1975 | Aldo | 156/505 |
| 4,070,854 | 1/1978 | Marino | 81/3.2 |
| 4,094,723 | 6/1978 | Jones | 156/506 |
| 4,094,726 | 6/1978 | Hujer et al. | 156/502 |
| 4,113,192 | 9/1978 | Osanai | 226/92 |
| 4,292,115 | 9/1981 | Jones et al. | 156/502 |
| 4,411,725 | 10/1983 | Siegel et al. | 156/502 |

*Primary Examiner*—Michael Wityshyn

*Attorney, Agent, or Firm*—Christensen, O'Connor, Johnson & Kindness

[57] ABSTRACT

A daylight film processing apparatus for removing an end cap of a cassette containing an exposed film and capturing the spool and film pushed outwardly therefrom so that the film can be suitably trimmed and identified and spliced to the tail of a next-preceding film and wound therewith onto a reel in a light-tight container for transfer to subsequent film processing equipment.

13 Claims, 10 Drawing Figures

DAYLIGHT APPARATUS FOR BREAKING OPEN A FILM CASSETTE, IDENTIFYING THE FILM RELEASED THEREFROM, AND SPLICING SAME TO THE NEXT PRECEDING FILM

My invention relates to a fully automated daylight film splicing apparatus for breaking open a cassette containing an exposed film and capturing the spool and film as pushed outwardly therefrom so that the film can be suitably trimmed and identified and spliced to the tail of a next-preceding film and wound therewith onto a reel in a light-tight container for transfer to subsequent film processing equipment.

The cassette comprehends a case and end caps forming an enclosure for a spool and a roll of film wound thereupon. From the time the cassette is loaded with unexposed light-sensitive film, the film is not touched, the photographer loading his camera by interrelating his cassette and camera. After film exposure, the cassette, with its spool and film normally finds its way to the film processor.

The invention teaches a fully automated splicing and encoding apparatus for photographic films designed to function in normal room light as it automatically removes a film from its cassette, trims the film ends, identifies the film, makes the splices to the next-preceding and next-succeeding films at its respective forward and rearward ends, and collects the continuous so-spliced films within a light-tight reel canister.

The identifying system is comprised of printing means within the apparatus for the imprinting of numbers or other indica, in human and/or machine readable form, as generated from an internal or external source, on a splicing tape, which tape is brought into sealing contact with the adjacent ends of a pair of tapes for serving the splicing purpose, and if desired on an associated envelope or other type of container by means of a similar printing mechanism.

As one exemplification, an identifying system may comprise the printing of the identifying symbol via a printing mechanism on the forward or leading end of a continuous splicing tape while incrementing the movements of the trailing end of a next-preceding identified film and the leading end of a next-succeeding film into positions of adjacency at a splicing station, severing as a tab the so-printed forward end from the splicing tape, and strategically sealing the severed tab to the adjacent film ends as a splice to that the printing on the tab will overlay the particular film relating thereto wherefor, upon eventual severance of the spliced films following processing, the printed portion of the tab will remain intact in overlying position upon its respective film. Similarly, another printing mechanism may print corresponding identifying indicia on the associated container or envelope so as to assure foolproof identification and proper correlating of film and envelope.

The sequence of steps in the operating cycle is as follows:

1. The cassette is introduced to the opening station and the proper orientation thereof is insured by a sensing means preliminary to machine operation.

2. The cassette is clamped to hold same stationarily while a carriage spindle is rendered operative for imparting a rotative motion to the spool and film within the cassette in the detection of any possible film reverse winding or binding.

3. One of the cassette end caps is removed by the manipulation of end cap removing fingers.

4. The spool and film are transferred from the cassette to a film manipulating area by the coaction of a pushing ram and a rotating carriage spindle, the ram pushing not only the spool and film outwardly of the cassette but also the carriage assembly rightward to its intermediate position.

5. The film is maintained in a taut condition on the freed spool for the preclusion of film uncoiling or fluffing.

6. The film lead end is picked off from the spool and is advanced through a roll couple and into position for the cutting of the lead end at the start of its full width, same having been detected.

7. The film lead end is passed through a slack box to allow for slackening as the spool is found and the film tail end is advanced to the cutting area for the severance of the spool at the tail end.

8. The splicing tape is imprinted with identifying indicia and the so-imprinted portion is severed to define a tab which is adhesively sealed to the abutting film ends of the film and the next preceding film.

9. The tail end of the film is advanced into position preparatory to the next subsequent splicing operation.

The invention is capable of a variety of mechanical expressions, one of which is shown on the accompanying drawings for purposes of illustration only, and same is not to be construed as a definition of the limits of the invention, reference being had to the appended claims for such purpose.

Figure 3:
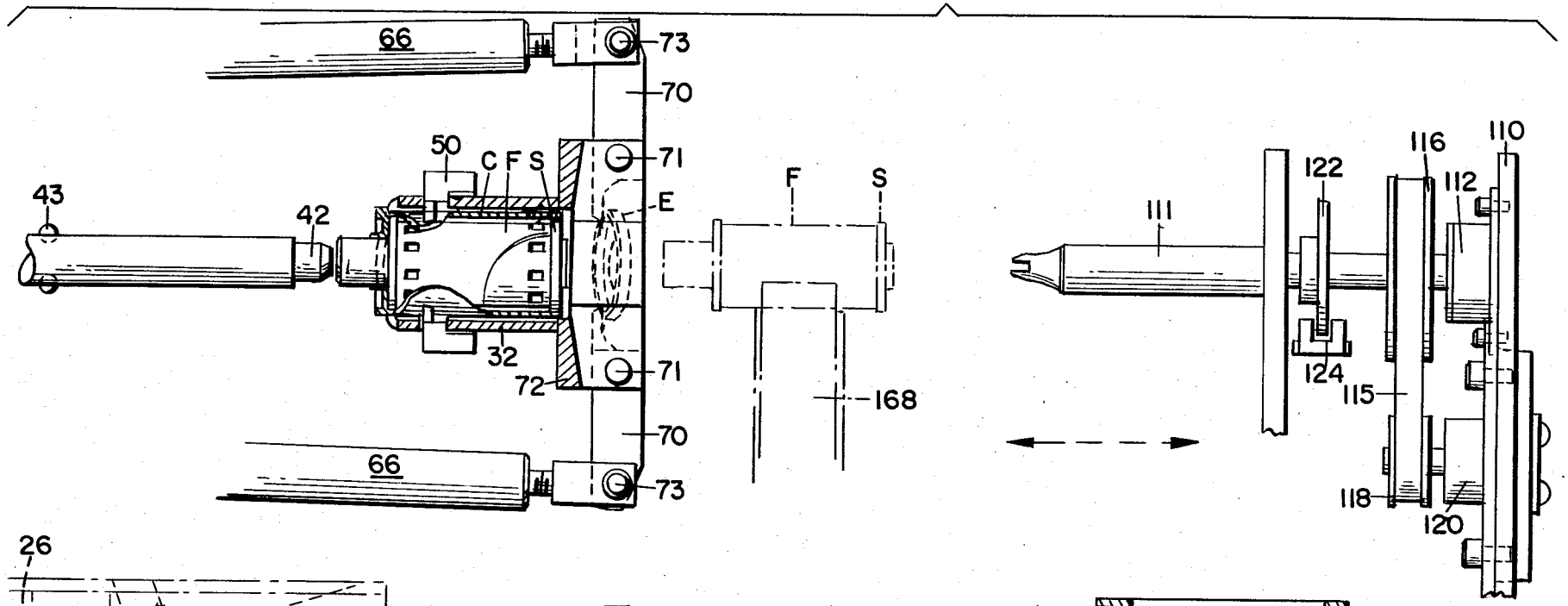
Figure 4:
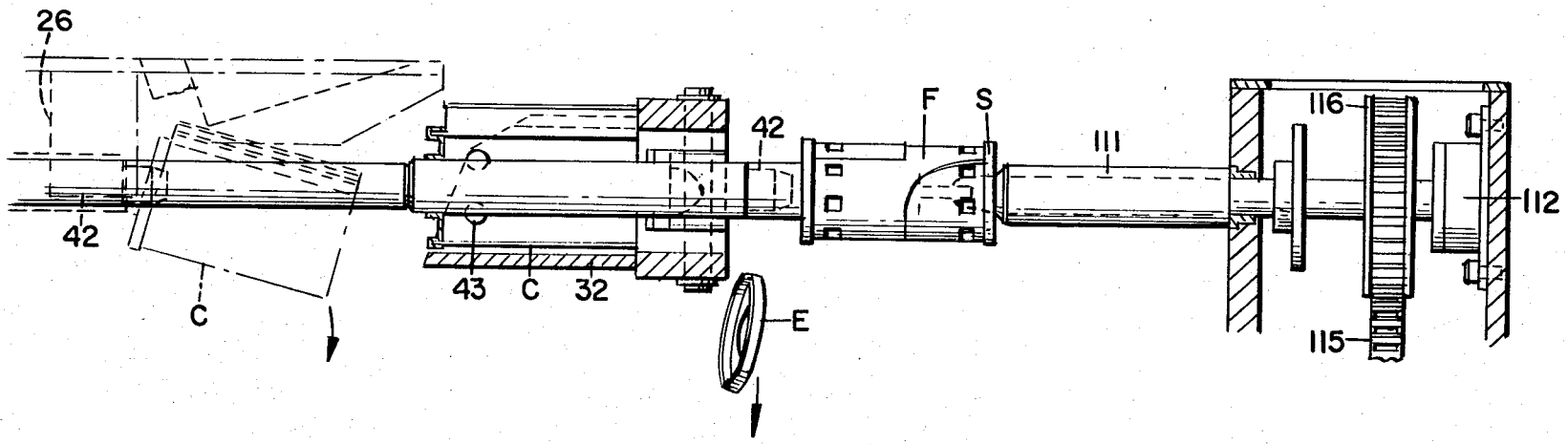
Figure 7:
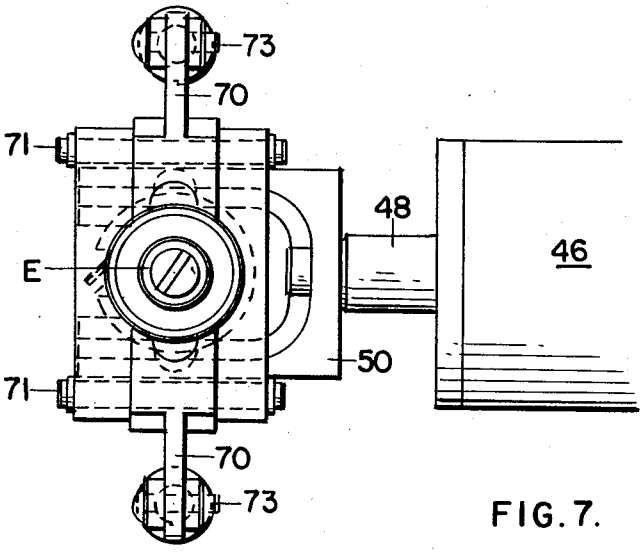
Figure 8:
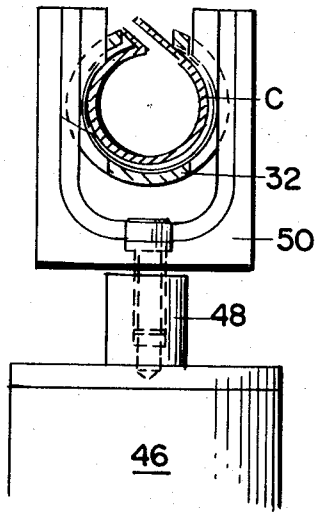
Figure 5:
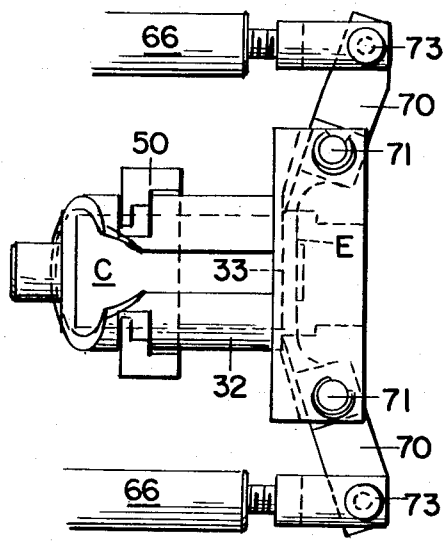
Figure 6:
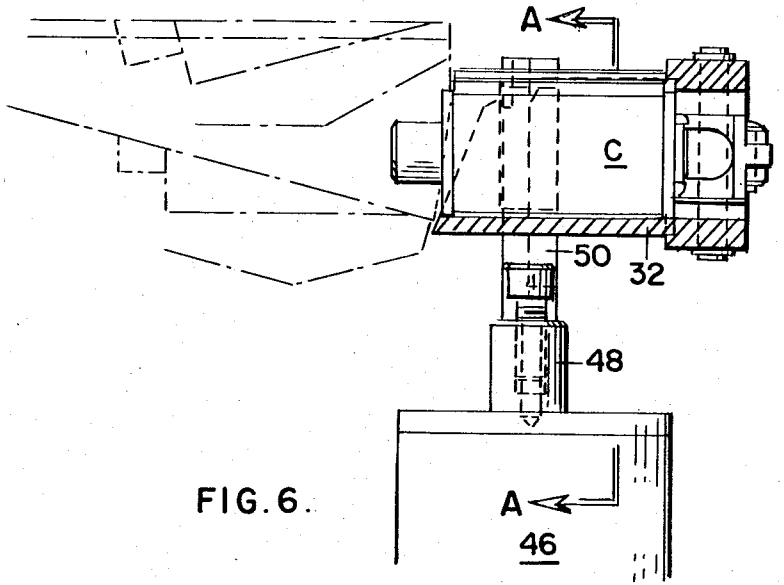

FIG. 3 is a schematic view, in top plan, of the opener/feeder assembly, showing the cassette end cap in the process of being removed and, in phantom, the film-carrying spool having been pushed axially forwardly into the film manipulating area, with certain parts of the carriage assembly being shown in a rightward position before assuming a leftward position in the cassette opening area for imparting a rotative motion to the spool and film while still within the cassette and for aiding in the support of the spool and film as same are pushed laterally forwardly into the film manipulating area;

FIG. 4 is a schematic view, in side elevation, of the ram spindle in forwardmost position, having pushed the spool and film into the film manipulating area and about to be withdrawn to rearwardmost position (shown in phantom) with the emptied cassette dropping into a suitable disposal area and with the carriage assembly being shown in its mid-operating position in the film manipulating area;

FIG. 5 is a schematic view, in top plan, of the cassette opening components;

FIG. 6 is a schematic view, in side elevation, of the FIG. 5 subassembly;

FIG. 7 is a schematic view, in end elevation, of the FIG. 5 subassembly;

FIG. 8 is a sectional view on line A—A of FIG. 6; and

Figure 9:
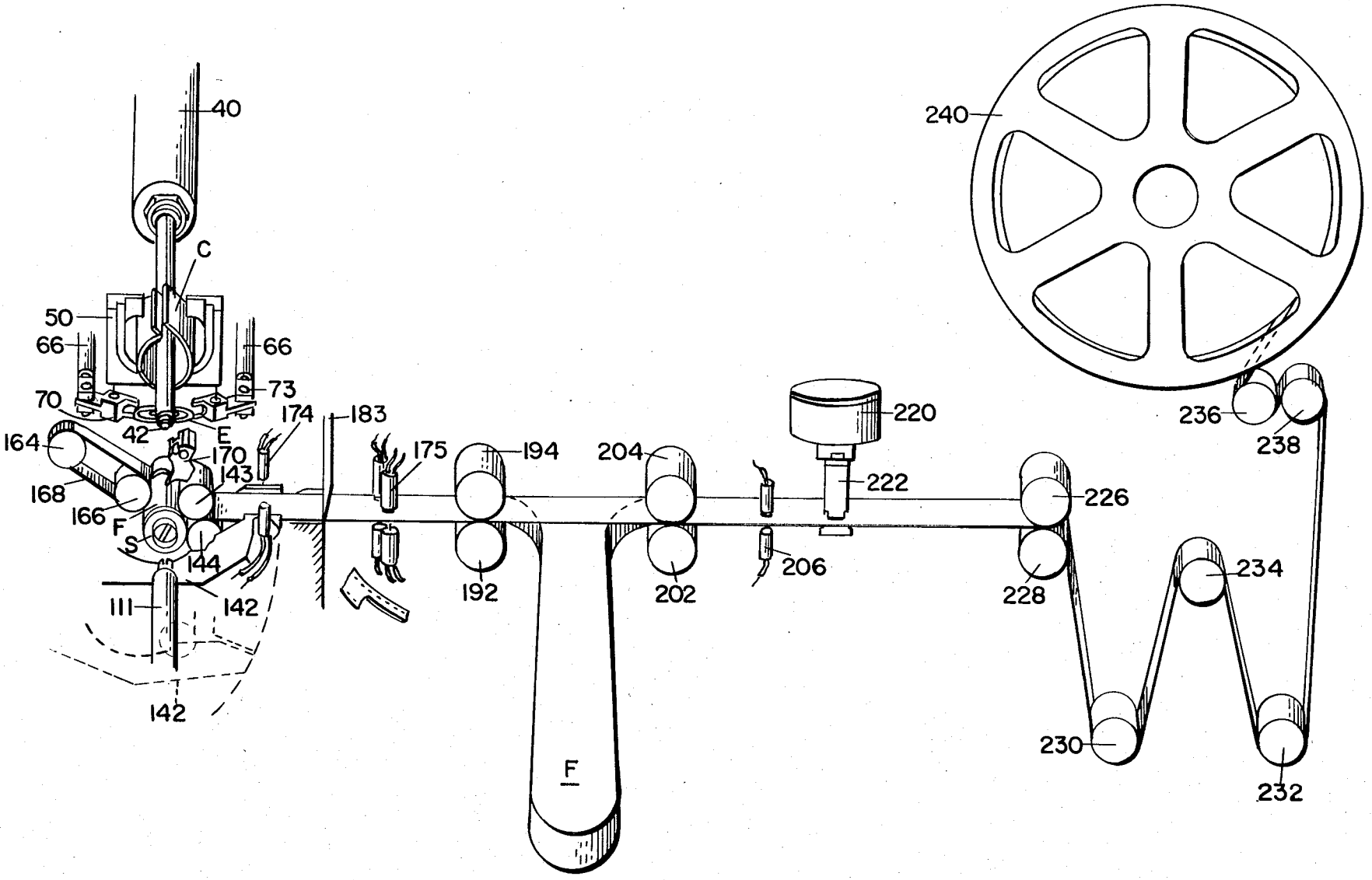
Figure 10:
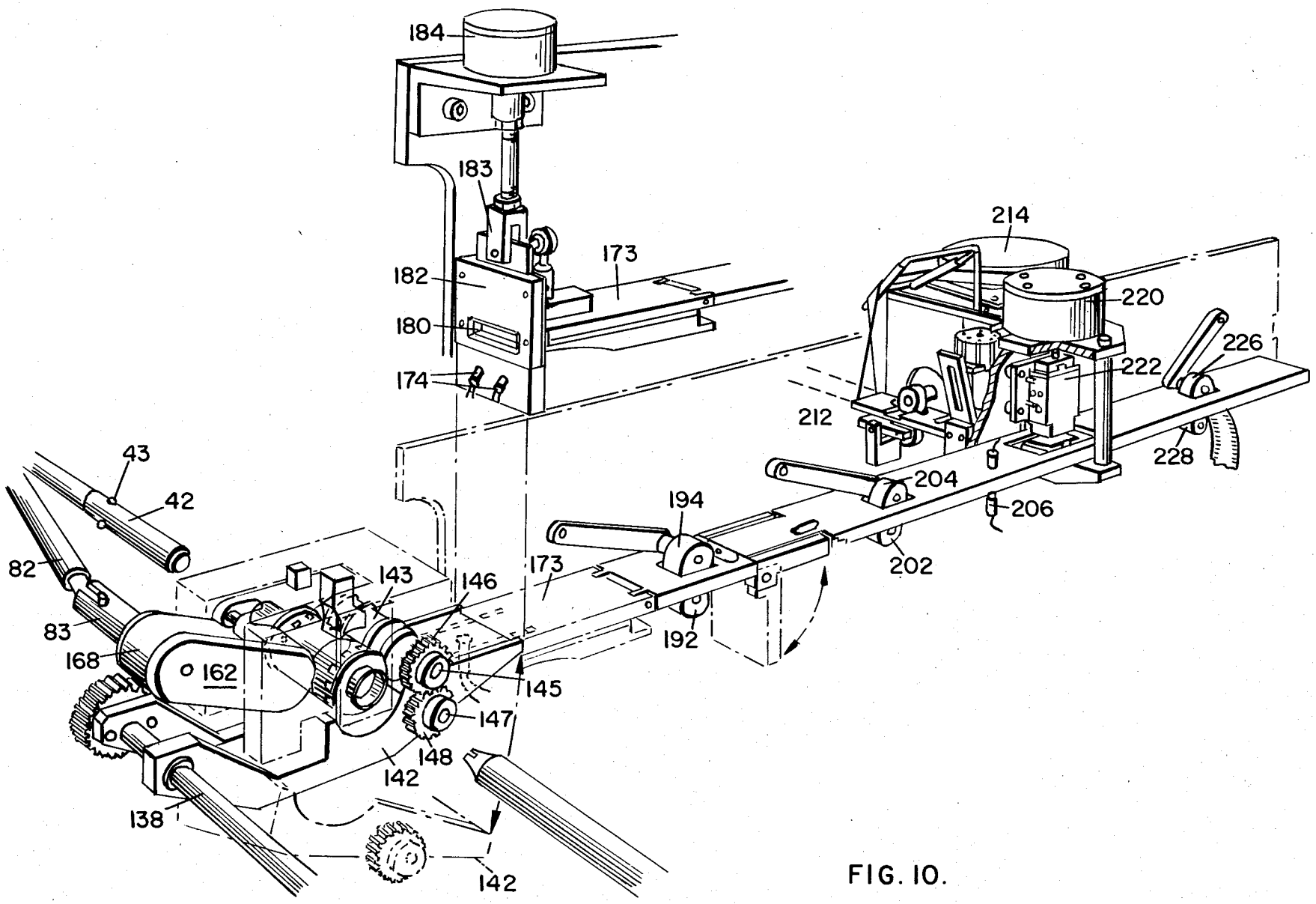

FIGS. 9 and 10 are schematic diagrams illustrating the film travel through the cassette opening and film manipulating and cutting and identifying and splicing and take up stations.

It will be understood that a housing accommodates, within its interior, a multi-compartment dark section each section being sealed against light entry and to each of which admission may be gained by a complemental access door in the tending side wall of the housing.

A support body is comprised of a series of vertically-disposed plates, a left end plate 10, an intermediate plate 12, and a right end plate 14, spaced as to each other and projecting upwardly from and fixed to a horizontally-disposed base plate 16.

A receiver door assembly, spaced upwardly of base plate 16 and supported by spaced vertically-disposed opener side plates 18, includes a receiver door frame 20 and a swingable receiver door 22 pinned by a pin 24 to the side plates 18, the pin being sleeved by a conventional biasing spring (not shown) for holding the door in a normal uppermost closed light-sealed position. During the machine cycle, a receiver door solenoid (not shown) is energized to latch the receiver door in closed position.

A cassette C, loaded with an exposed film F on a spool S, is properly oriented in a cassette-receiving recess 30 in the receiver door so that door and cassette may be manually urged downwardly with a door stop 28 limiting pivotal movement of the door as the cassette is delivered to the cassette opening station, the clearance being sufficient to allow the cassette to be charged into an accommodating cassette-receiving tube 32. So delivered, the door is biased returnably to its normal light-sealed position.

Cassette receiving tube 32 is configured so that the cassette can be successfully introduced thereto in only one way. Further the tube is provided with a stop 33 at its forward end for limiting movement of the cassette within the tube beyond a predetermined forward position.

A microprocessor-controlled carriage assembly is driven by a system which includes a short carriage cylinder 100 and a coaxially aligned long carriage cylinder 101 intercoupled by a coupling 103, which components extend forwardly from the left end plate and through the intermediate plate and serve to shift the carriage assembly between rightward, intermediate and leftward positions, the carriage being supported in such shifts by a pair of spaced support rods 109. Microswitches 104 mounted on carriage switch blocks 106 on one of the support rods 109 define and control the outer limits of the leftward and rightward travel of the carriage assembly.

The carriage assembly includes a vertically-disposed carriage plate 110 mounting a carriage spindle 111, extendable through and cooperant with a clutch 112. The carriage spindle is driven by a carriage belt 115 entrained around a carriage spindle pulley 116 and a motor shaft pulley 118 drivingly connected to a microprocessor-controlled carriage spingle motor 120 supported on carriage plate 110.

The carriage assembly, when actuated into leftward position, allows the extension of the forked end of the carriage spindle through the aligned opening in the cassette end cap for engagement with the spool therewithin so as to impart a rotative motion thereto in the function of sensing any reverse winding or binding of the film on the spool in the cassette and to aid in film transfer from the cassette opening to the film manipulating area.

An encoder 122 on the carriage spindle and a cooperating encoder sensor 124 detect the turning of the carriage spindle and hence the free turning of the spool and film in the normal and proper rotative direction within the cassette. Failure so to freely drive the spool and film is to signal a reverse wound film or a bound film condition leading to a rejection of the cassette and its contained spool and film.

The cassette opening subassembly includes an upwardly-facing vertically-extending cassette gripper or clamp 50 driven by the piston 48 of a microprocessor-controlled air cylinder 46, with the gripper defining a pair of spaced jaws offering opposite cassette-embracing surfaces for reliably holding the cassette in fixed position as the gripper is projected upwardly into operating position, the subassembly further includes a microprocessor-controlled opener cylinder 58 which mounts a piston extendable forwardly through left end plate 10 and has fixed at its free forward end a trunnion 60 for the pivotal support relative thereto of a transversely-extending lever bar 62.

Figure 1:
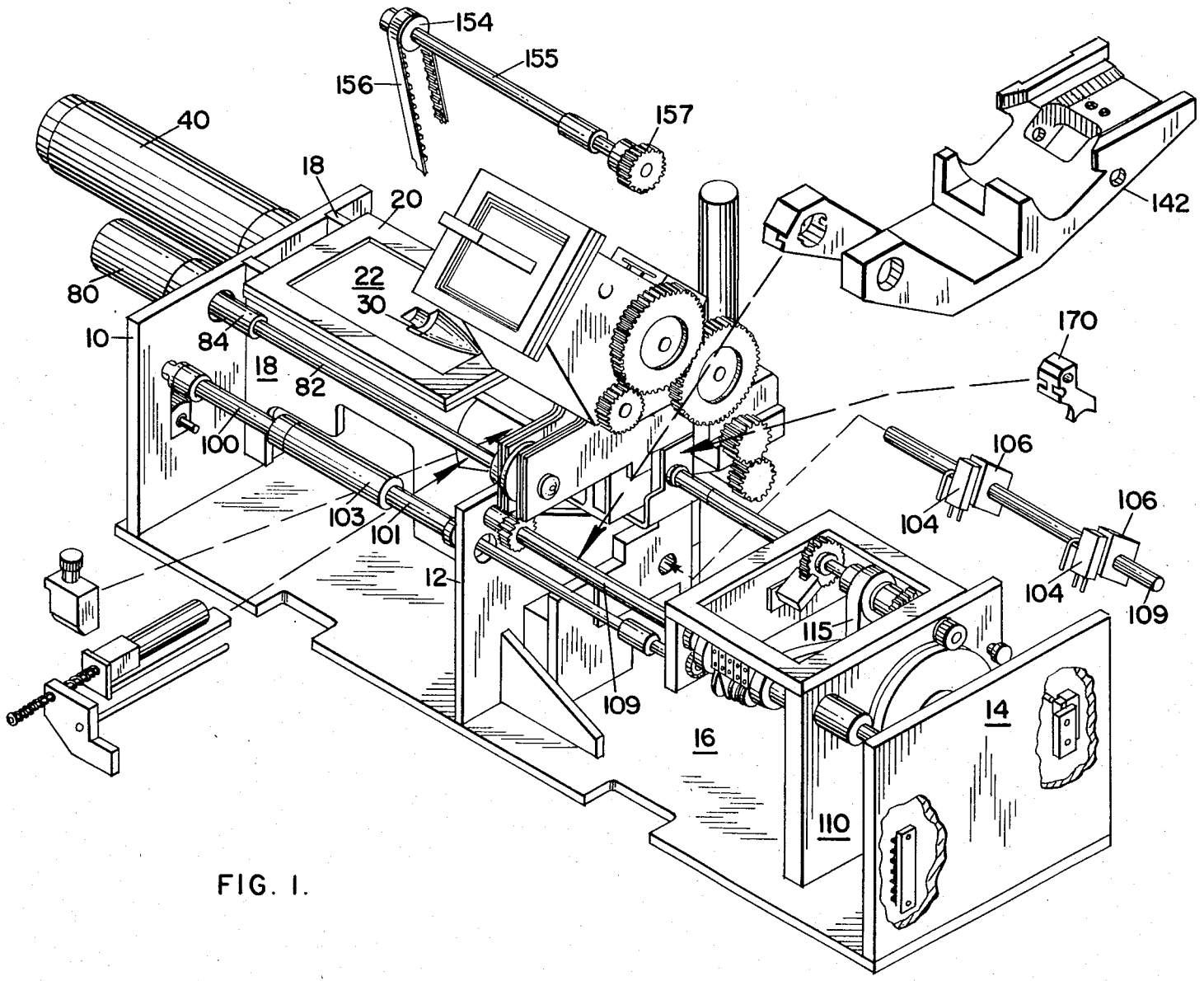
FIG. 1 is an exploded isometric view of certain components of the opener/feeder assembly, with some parts being removed for clarity purposes.
Figure 2:
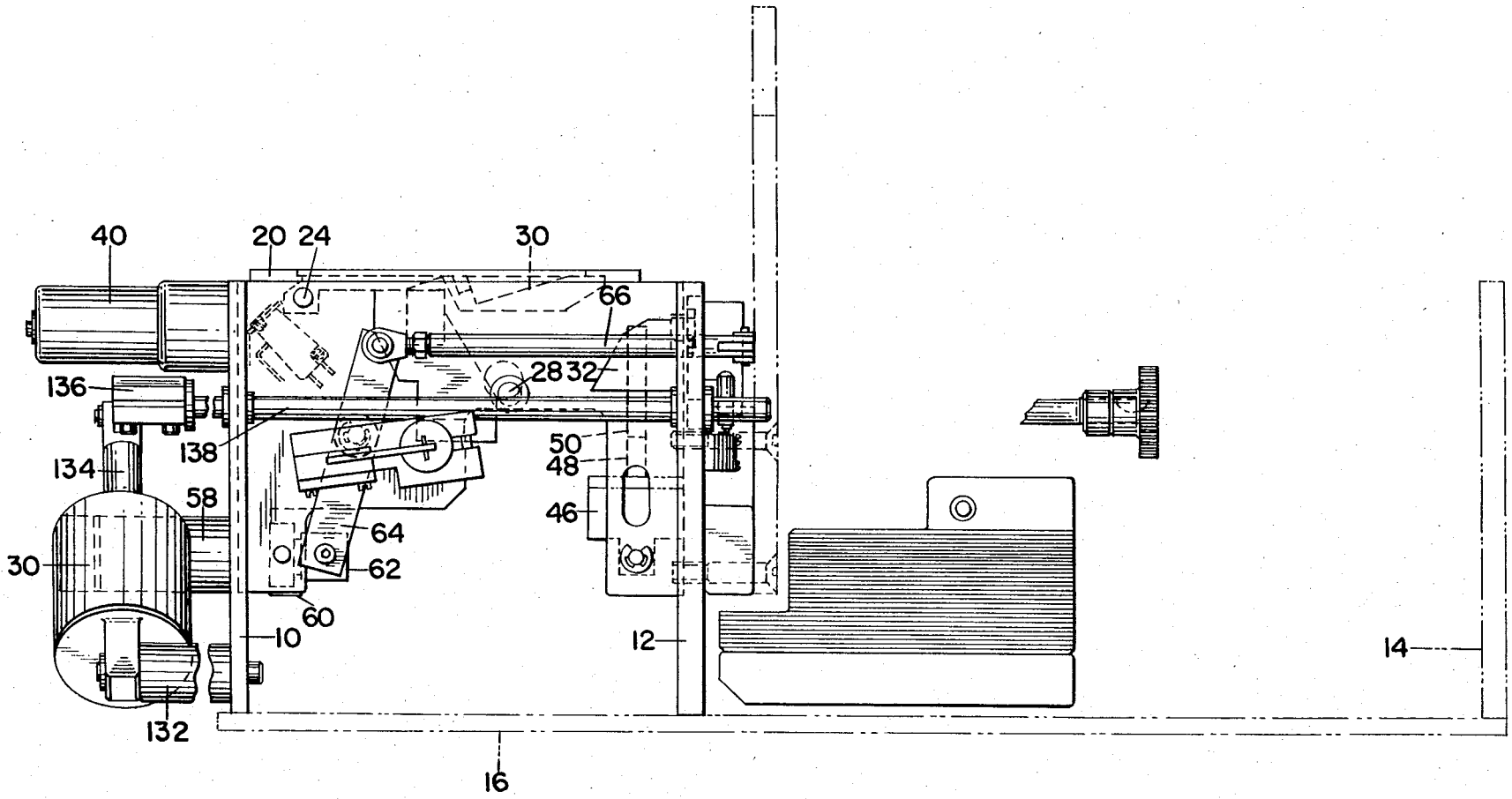
FIG. 2 is a view in side elevation, partly in section, of certain of the components of the opener/feeder assembly.

A pair of spaced levers 64, pivotally mounted on lever bar 62, offer upper extremities which are each pivotally engageable with the complemental one of a pair of spaced horizontally-disposed tie rods 66. Each tie rod is extendable through intermediate plate 12 and pivotally mounts at its forward extremity one of the suitably shaped opener fingers 70. The opener fingers are pivotally mounted by pins 71 on opposite sides of a finger block 72 which offers a stop against which the cassette bears as the gripper maintains its pressure on the cassette and the opener fingers serve their end cap removal function. As tie rods 66 are pulled rearwardly or leftwardly, as in FIG. 2, they cause their respective opener fingers, pivoted thereto by respective clevis pins 73, to pry the end cap E from the cassette.

A microprocessor-controlled ram cylinder 40 supported by left end plate 10 mounts a ram live spindle 42. The spindle is reciprocated forwardly and rearwardly and is centered so as, on forward stroke, to enter the cassette end cap opening and spool bore preparatory to driving the freed end cap, spool, film, and carriage spindle laterally forwardly and outwardly of the cassette and into the film manipulating station.

Initially, in the film manipulating station, both ram spindle 42 and carriage spindle 111 support the freed spool and its film.

A microprocessor-controlled pinch motor 80, supported by left end plate 10, has a drive shaft 82 coupled thereto by a rear drive shaft coupling 84. The drive shaft has a forward end linked to a pinch roll drive shaft 83 which supports a pinch roll assembly inclusive of a pair of spaced side plates 162.

Between the side plates, a primary roll 164 is mounted on and rotatable with the pinch roll drive shaft and spaced therefrom a secondary roll 166 is rotatably mounted. A pinch roll belt 168 is entrained around the primary and secondary rolls.

A microprocessor-controlled lower jaw cylinder 130 is pivotally supported on left end plate 10 by a lower jaw cylinder mounting assembly 132, the cylinder mounting a piston 134 having an outboard end pivotally linked to a pivot shaft cylinder clamp 136. Fixed to the clamp is a forwardly extending lower jaw pivot shaft 138 upon which a lower jaw 142 is mounted for swinging movement between a lower opened position (shown in phantom in FIGS. 9 and 10) and an upper closed position, as controlled by the rotative motion of the lower jaw pivot shaft.

In upper closed position of the lower jaw, the lower jaw serves to receive the spool and film as it is pushed theretoward from the cassette opening area and is supported by the carriage spindle. The rotatable pinch roll belt assumes an embracing position against the film so as to keep the film taut with respect to its spool in the desired avoidance of any film fluffing or coning after transfer and while the film lead end or tongue is being searched for and picked off or peeled from the spool by means of a stripper finger 170.

As the lower jaw is brought into upper closed position, a roll couple nested therewithin and formed by an upper roll 143 and a lower roll 144 is brought into operative position. The upper roll is rotatable on an upper drive shaft 145 and mounts a driving gear 146 and the lower roll is rotatable on a lower idler shaft 147 and is driven through a gear mounted thereon and intergeared with gear 146. A drive pulley 154, mounted on a drive shaft 155 with a drive belt 156 being entrained over the pulley drives an input gear 157 which, through a drive train, drives the upper drive shaft 145 and its driving gear 146.

As stripper finger strips and peels the film lead or tongue from the spool, it presents it to the nip of rolls 143 and 144 whereby the forward film advancement is initiated along a track 173 until a first pair of sensors 174, sensing the film lead end, initiate deenergization of pinch roll belt 168 and the raising of stripper finger 170 as the film lead end is advanced through an opening 180 in a guillotine 182 and a knife 183 thereof.

A second pair of sensors 175 detect the commencement of the full width of the advancing film so as to stop further film advancement while a vertically reciprocable knife 183 in the guillotine is driven downwardly by a microprocessor-controlled air driven knife cylinder 184 so as to cut off the film lead end, same being disposed of as film waste for silver recovery.

The film is then again advanced through a roll couple comprised of a driven lower feed roll 192 and an upper idler roll 194 before passage through a slack loop door 196 and into a slack area therebelow where the film may be looped to accommodate to any resulting slack while the film is advanced to the next cutting operation when the tail end waste and spool are severed from the film.

The film is next passed through a second roll couple made up of a driven lower feed roll 202 and an upper idler roll 204 serving to advance the film to a splicing and identifying station.

An edge sensor 206 detecting the lead end of the film energizes a stepping motor so as to commence a count for the film advancement until the lead end is located in situ adjacent the trailing edge of the next-preceding film already positioned in proper location for the splicing procedure.

The forward end of a tape 212 is printed with identifying indicia by means of a printing mechanism 214. A significant point here is that this printing ensues within the machine per se and not at some distant site with transfer to the machine.

The splicing and identifying station further includes a microprocessor-controlled splice head cylinder 220 for driving a vertically-depending sealing iron 222 downwardly into sealing position and upwardly away therefrom.

As the sealing iron is lowered to sealing position, a knife severs the so-printed forward end of tape 212 in the form of a tab and causes the tab to be sealed to both the tail end of the next-preceding film and the lead end of the next-succeeding film.

The overprinting of the tape may be selectively positioned thereon so that when the tab is severed therefrom, the printed portion of the tab will overlie and be adhesively secured to either the tail end of the next-preceding film or the lead end of the next succeeding film, as desired, and according to which film is being identified thereby. Then eventually, following processing, and when the individual films are severed from each other the overprinted portion of the tab will continue in its adherence to the film identified thereby.

One significant advantage hereof is that the identification is printed on the splicing tape before the tab is adhered to the adjacent films meaning, obviously, the avoidance of any need for passaging the film through any printing mechanism and of any scratching resultant therefrom.

With the film slack being taken up in the slack box, the film continues to be unreeled from its spool until the tail end is found and it's brought to the guillotine where the cutting knife is energized for a return or upward stroke.

The solenoid having held the knife of the guillotine in down position since the earlier cutting of the film lead end, is now energized to allow the same to be returned vertically-upwardly to upper position, cutting the film in its upstroke by virtue of a second cutting edge at the lower edge of the knife opening through which the film has been passaging.

The forwardly-advancing spliced films are passed through the nip of an adjustable upper pressure roll 226 and a lower final drive roll 228 for threading onto a festooned arrangement of spaced dancing rolls 230 and 232 mounted on the usual reciprocable dancing roll or tension arms (not shown) with interdigitated stationary roll 234 mounted on the housing for advancement of the film before passage upwardly through rolls 236 and 238 and onto a reel 240 which reel is rotated in winding direction by a reel drive motor (not shown).

I claim:

1. An opener system enclosed within a light tight enclosure for opening a cassette containing a film rolled on a spool and having a removable end cap comprising the combination of:

means for introducing a cassette into the enclosure and to a cassette opening station, a movable clamp for movement into and out of cassette-embracing position for stationarily holding the cassette during the opening mode, a pair of mutually movable jaws pivotable into and out of operating positions on opposite sides of the cassette for removing the end cap from the cassette, an axially reciprocating pusher-puller capable of a forward motion for pushing the spool and film outwardly of the cassette and into a film-manipulating station and a rearward motion for pulling the empty cassette into a position for gravity fall away from the cassette opening station, and drive means for cyclically actuating the clamp and jaws and pusher-puller.

2. The opener system of claim 1 wherein said means for introducing said cassette includes:

a cassette-receiving tube for receiving the introduced cassette and stop means associated with said tube for limiting the position of the cassette relative to the tube.

3. The opener system of claim 1 wherein said cassette-introducing means includes:

a cassette-receiving tube for receiving a properly introduced cassette, and sensing means associated with said tube for detecting proper cassette orientation.

4. The opener system of claim 1 further including:

means for rotating the spool and film in the introduced cassette in a first direction of rotative movement, and means associated with said rotating means for sensing a condition of film winding or film binding in a direction opposite said first direction.

5. In a film processing apparatus for handling a cassette containing a film rolled on a spool, an improvement in a cassette-emptying system comprising:

a clamp means for stationarily holding the cassette, an axially reciprocating pusher-puller capable of a forward motion for pushing the spool and film outwardly of the cassette and into a film-manipulating station, and drive means for cyclically actuating the forward motion of said pusher-puller.

6. The film processing apparatus of claim 5, wherein said pusher-puller is capable of a rearward motion for pulling the emptied cassette into a disposed position, and said drive means cyclically actuates the rearward motion of said pusher-puller.

7. In a film processing apparatus for handling a cassette containing a film wound on a spool and having a cassette-opening station and a film-manipulating station, the improvement in transferring a spool and film from said cassette-opening station to said film-manipulating station comprising:

a reciprocating pusher-puller for pushing the spool and film laterally and outwardly of the cassette, a carriage cylinder assembly for receiving and supporting the laterally transferred spool and film, and drive means for cyclically actuating the pusher-puller and carriage cylinder assembly.

8. The film processing apparatus of claim 7 further including means for rotating the spool and film while in transit between said cassette-opening station and said film-manipulating station.

9. The film-processing apparatus of claim 8, further comprising an improvement in a finding system for finding the lead film end on a spool including:

means for insuring tautness in the spool winding as the spool is rotated, stripper means for finding the lead film end and peeling the film from the spool and guiding same, a roll couple for receiving the guided film into the nip thereof, and second drive means for cyclically driving the tautness means and stripper finger means and roll couple.

10. An opener for a cassette containing a film rolled on a spool and having a removable end cap comprising the combination of:

a movable clamp for movement into and out of cassette-embracing position for stationarily holding the cassette during the opening mode, a pair of mutually movable jaws pivotable into and out of end cap prying positions on opposite sides of the cassette for prying the end cap from the cassette, an axially-reciprocating pusher-puller capable of a forward motion for pushing the spool and film outwardly of the cassette and into a film-manipulating station and a rearward motion for pulling the empty cassette into a discharging position, and drive means for actuating the clamp and jaws and pusher-puller in a cyclical relationship.

11. Apparatus for preparing exposed film for processing and inclusive of means for opening a cassette having a removable end cap and containing a film rolled on a spool and means for transferring the film from the cassette into a position for lengthwise movement for trimming and identifying and splicing operations comprising:

a light free enclosure, means for introducing a loaded cassette into the enclosure and to a cassette-opening position therein, holding means for stationarily securing the cassette during the cassette-opening mode, prying means for prying the end cap from the cassette during the cassette-opening mode, means for laterally pushing the spool and film free of the cassette, means for pulling the empty cassette into a discharging position, film rotating means for rotating the freed film and spool, pinch roll means for holding the rotating film against uncoiling and fluffing, finding means for finding the film tongue, roll couple means accepting the film tongue and drawing the film away from the spool, spool ejecting means for ejecting the emptied spool away from the film manipulating station, and drive means for cyclically actuating the cassette opening and film manipulating mechanisms.

12. In apparatus for preparing exposed film for subsequent processing and including a cassette opening system for opening a cassette containing a film rolled on a spool and having a removable end cap and a manipulating system for transferring the film into and moving along a lengthwise path of movement for trimming and identifying and splicing of the film, the combination of:

clamp means for movement into a cassette-holding position only and jaw means pivotable into an end cap prying position during the opening mode, an axially-reciprocating pusher-puller means for pushing the spool and film outwardly of the cassette and into position for assuming the movement along the lengthwise path, film rotating means for rotating the film and spool, pinch roll means for embracing the rotating film and ensuring against uncoiling, finding means for finding the film tonque, roll couple means for receiving the film tongue and drawing the film away from the spool, spool ejecting means for ejecting the emptied spool, trimming means for trimming the lead end of the film preparatory to the splicing thereof to the tail end of the next preceding film, means for printing film identifying indicia on a leading tab end of a splicing tape, means for moving the tab end of the splicing tape into splicing position between the adjacent trailing end of a next preceding film and the leading end of the next succeeding film means for severing the tab end from the splicing tape, means for sealing the tab on the adjacent film ends, and means for cyclically driving the cassette opening and film manipulating mechanisms.

13. Apparatus for preparing exposed film for processing and inclusive of means for opening a cassette having a removable end cap and containing a film rolled on a spool and means for manipulating the film from the cassette into a position for lengthwise movement through trimming and identifying and splicing operations comprising:

a light free enclosure, introducing means for leading a loaded cassette into the enclosure, holding means for holding the cassette, removing means for removing the end cap from the cassette and for pushing the spool and film forwardly free of the cassette and for pulling the empty cassette rearwardly into a discharging position, film rotating means for rotating the freed film and spool, pinch roll means for holding the rotating film against uncoiling and fluffing, finding means for finding the film tongue, roll coupled means for accepting the film tongue and drawing the film away from the spool, spool ejecting means for ejecting the emptied spool away from the film mainpulating station, printing means for printing a respective film identifying symbol for a film on the tab end of a splicing tape, means for bringing the trailing end of a next-preceding film and the leading end of a next-succeeding film into positions of adjacency, means for severing the tab end from the splicing tape and sealing the same upon the adjacent film ends with the identifying symbol on the tab overlying the identified film, drive means for cyclically actuating the cassette opening and film manipulating mechanisms.

* * * * *

UNITED STATES PATENT AND TRADEMARK OFFICE

CERTIFICATE OF CORRECTION

PATENT NO. : 4,543,151

DATED : September 24, 1985

INVENTOR(S) : Bruce D. Aldo

It is certified that error appears in the above-identified patent and that said Letters Patent is hereby corrected as shown below:

| | | |
|---|---|---|
| Column 1, | Line 21: | Insert --,-- (comma) after "film" |
| Column 2, | Line 17: | "found" should be --wound-- |
| Column 3, | Line 4: | Insert --,-- (comma) after "section" |
| Column 3, | Line 7: | "side wall" should be --sidewall-- |
| Column 3, | Line 54: | "cooperant" should be --in cooperation-- |
| Column 6, | Line 25: | Insert --,-- (comma) after "solenoid" |
| Column 6, | Line 31: | "passaging" should be --passing-- |
| Column 7, | Line 26: | Delete "," (comma) after "5" |
| Column 7, | Line 26: | Insert --:-- (semicolon) after "5" |
| Column 8, | Line 65: | Insert --,-- (comma) after "film" |
| Column 10, | Line 17: | Insert --and-- after "film," |

Signed and Sealed this

*Twenty-fourth* Day of *December 1985*

[SEAL]

*Attest:*

DONALD J. QUIGG

*Attesting Officer*

*Commissioner of Patents and Trademarks*